United States Patent [19]

Maekawa

[11] Patent Number: 4,633,808

[45] Date of Patent: Jan. 6, 1987

[54] DEVELOPING PROCESS FOR ELECTROPHOTOGRAPHY USING A TWO-COMPONENT DEVELOPER

[75] Inventor: Kouji Maekawa, Kyoto, Japan

[73] Assignee: Mita Industrial Co., Ltd., Osaka, Japan

[21] Appl. No.: 726,354

[22] Filed: Apr. 23, 1985

[30] Foreign Application Priority Data

Apr. 27, 1984 [JP] Japan ..... 59-86849

[51] Int. Cl.[4] ..... G03G 13/08

[52] U.S. Cl. ..... 118/658; 430/122

[58] Field of Search ..... 118/657, 658, 612; 430/120, 122

[56] References Cited

U.S. PATENT DOCUMENTS 4,444,864 4/1984 Takahashi ..... 430/120

FOREIGN PATENT DOCUMENTS 2128902 5/1984 United Kingdom .

*Primary Examiner*—John L. Goodrow

*Attorney, Agent, or Firm*—Spencer & Frank

[57] ABSTRACT

A developing process for electrophotography comprising: (1) feeding a developer to a non-magnetic sleeve, said developer consisting of an insulative and non-magnetic toner charged with an electrical polarity and a magnetic carrier, (2) maintaining said developer on the sleeve, (3) removing said carrier from said developer on the sleeve to leave said non-magnetic toner on the sleeve, and (4) transferring said non-magnetic toner from the sleeve to an electrostatic latent image on the surface of a photoreceptor.

6 Claims, 1 Drawing Figure

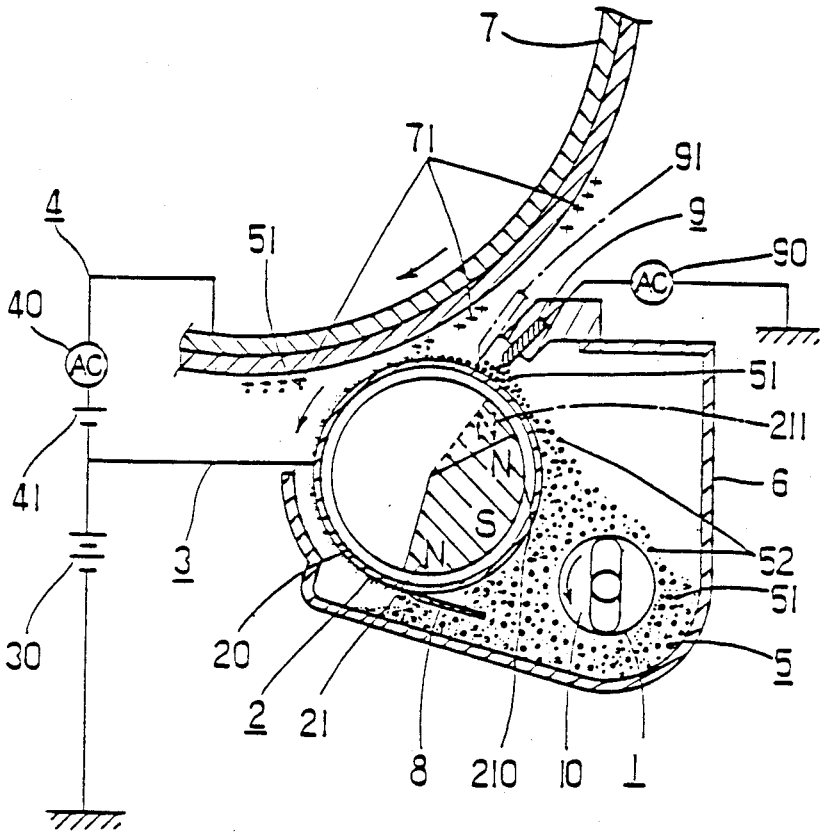
7
71
91
9
90
4
51
40
AC
AC
51
211
41
6
3
S
N
N
52
51
30
20
5
2
21
8
210
10
1

DEVELOPING PROCESS FOR ELECTROPHOTOGRAPHY USING A TWO-COMPONENT DEVELOPER

BACKGROUND OF THE INVENTION

1. Field of the invention

This invention relates to a developing process for electrophotography whereby a single-component non-magnetic toner is uniformly and reliably bound to an electrostatic latent image on the surface of a photoreceptor.

2. Description of the prior art

In a dry-type developing process for electrophotography, an excellent visible image results from the uniform and reliable formation of a toner layer on an electrostatic latent image on the surface of a photoreceptor. As a developer, there has been a two-component developer which is composed of a toner consisting of a variety of pigments, resin binders, etc., and a carrier giving charges to the toner; and a single-component developer consisting of a toner. For both developers, it is necessary for the toner to be uniformly and stably charge with electricity and the resulting charged toner should be uniformly and reliably transferred to the desired electrostatic latent image region on the photoreceptor.

The two-component developer is widely used since the toner therein can be easily produced and readily charged. The toner in the two-component developer is charged by friction with the carrier, and accordingly as the toner is consumed for the development treatment of the latent image, fresh toner must be supplied to maintain the amount of electric charge of the developer at a certain level. This oepration is quite troublesome and often difficult. When a certain amount of toner of the two-component developer is bound to the electrostatic latent image on the surface of the photoreceptor by means of a magnetic brush development, etc., the concentration ratio at the tip of the brush of the toner to the carrier must be maintained at a certain level. This is also quite difficult. Since the tip of the brush containing a rigid carrier composed of iron particles or glass beads is in contact with the surface of the photoreceptor, the surface of the photoreceptor becomes damaged. If the carrier is electroconductive, electric charges leak at the time when the carrier contacts the latent image on the photoreceptor resulting in a brush mark in the obtained visible image. In order to eliminate these drawbacks of the two-component developer, a non-contact development using a single-component developer has been recently proposed, wherein since a single-component toner is used, regulation of the toner concentration is not required and the control of supply of the toner is simplified. Especially, in a "jumping" development using a magnetic toner, the toner is fed to the surface of a photoreceptor by a "jumping" process, thereby forming an excellent visible image on the photoreceptor without damaging the surface of the photoreceptor. However, each of the toner particles must be charged using a sleeve having a specially treated surface to increase the charge efficiency of the sleeve and the toner, or using a corona charger. These charging methods give an insufficient and non-uniform amount of charge to the toner thereby creating a fog phenomenon and toner scattering, resulting in a visible image which is inferior in resolution.

On the other hand, in the preparation of a single-component toner, the dispersion of a magnetic material such as magnetite, etc. into a resin is so difficult that each of the obtained toner particles has a non-uniform magnetic force and a non-uniform diameter. Moreover, since the magnetic material is rigid, it tends to damage the surface of a photoreceptor when the surface of the photoreceptor is subjected to cleaning by means of a blade.

SUMMARY OF THE INVENTION

The developing process for electrophotography of this invention which overcomes the above-discussed disadvantages and other numerous drawbacks of the prior art, comprises:

(1) feeding a developer to a non-magnetic sleeve, said developer consisting of an insulative and non-magnetic toner charged with an electrical polarity and a magnetic carrier, (2) maintaining said developer on the sleeve, (3) removing said carrier from said developer on the sleeve to leave said non-magnetic toner on the sleeve, (4) vibrating said non-magnetic toner on the sleeve as desired, and (5) transferring said non-magnetic toner from the sleeve to an electrostatic latent image on the surface of a photoreceptor.

The developer is, in a preferred embodiment, maintained on the sleeve by means of at least one fixed magnet desposed behind the sleeve. The magnet is disposed at a distance from the surface of the photoreceptor. The portion of the magnet which is closest to the photoreceptor is the same polarity as the adjacent portion of the magnet.

A bias potential having a different polarity from the polarity of the charged toner is applied to the sleeve.

Thus, the invention described herein makes possible the objects of (1) providing a developing process for electrophotography wherein a toner layer is formed uniformly and reliably on an electrostatic latent image on the surface of a photoreceptor, resulting in an excellent visible image; (2) providing a developing process for electrophotography wherein using a simple apparatus and a simple operation, a single-component toner brush or layer is formed on the sleeve to attain a non-contact development or a contact development; and (3) providing a developing process for electrophotography wherein an excellent visible image can be obtained without damaging the surface of the photoreceptor.

BRIEF DESCRIPTION OF THE DRAWINGS

This invention may be better understood and its numerous objects and advantages will become apparent to those skilled in the art by reference to the accompanying drawing as follows:

FIG. 1 is a schematic illustration showing the developing process for electrophotography according to this invention.

DESCRIPTION OF THE PREFERRED EMBODIMENTS

FIG. 1 shows a developing apparatus of this invention, which comprises a feeding means 1 for feeding a developer 5 to a sleeve 20, said developer being composed of a non-magnetic toner 51 charged with a given polarity and a magnetic carrier 52 holding the non-magnetic toner 51 thereon due to the electrostatic force; a holding means 2 for holding the developer 5 on the sleeve 20; and a separating means 3 for separating the carrier 52 from the non-magnetic toner 51. This apparatus further comprises a transferring means 4 for transferring the separated toner 51 to an electrostatic latent image 71 on the surface of a photoreceptor 7.

As the feeding means 4, for example, an agitation roller 10 is employed, but is not limited thereto, which may be installed within a developer tank 6. The toner 51 and the carrier 52 are mixed by the agitation roller 10 such that friction therebetween induces an electrostatic charge on the toner and the carrier, each of the polarities of which depends upon the order of charging tendency therebetween or the dielectric constant of the carrier. (The toner 51 is, for example, charged with a negative polarity.) Such friction between the toner and the carrier in the two-component developer causes the toner to be charged reliably and uniformaly because the non-magnetic toner particles 51 are composed of resins and pigments such as carbon, etc. and are excellent in dispersion into the carrier particles. The charged toner 51 is fed to the sleeve 20 together with the carrier 52 by the agitation roller 10. The sleeve 20 is made of an electroconductive and non-magnetic material such as aluminum, etc. The toner 52 and the carrier 52 which have been mixed by a agitation means (not shown) can be directly fed to the sleeve 20 without using the agitation roller 10.

The holding means 2 comprises the sleeve 20 and at least one magnet 21 disposed behind the sleeve 20. The magnet 21 is held by a fixing means. The sleeve 20 is rotatable around the magnet 21 by means of a driving means (not shown). Since the carrier 52 bearing the toner 51 is made of a magnetic material such as iron particles or the like, the carrier 52 adheres to the surface of the sleeve 20 and forms a brush thereon in the direction of magnetic lines of force of the magnet 21. The direction and the density of the magnetic lines of the developer 5 on the sleeve 20 vary as the sleeve 20 turns. The magnetic force of the magnet 210 which is closest to the photoreceptor 7 decreases gradually toward the turning direction of the sleeve 20, so that as the carrier 52 is carried by the sleeve 20 and comes close to the photoreceptor 7 beyond the end portion 210 of the magnet 21, the carrier 52 becomes free from the magnetic force of the magnet 210 and slips off of the sleeve 20 due to its own weight.

The separating means 3, which functions by cooperation with the magnet 21, comprises an application means 30 for applying a bias potential having a different polarity from the polarity of the charged toner 51 (i.e., the same polarity as the carrier 52) to the surface of the sleeve 20. Thus, when the carrier 52 is carried by the sleeve 20 to approach the photoreceptor 7 and arrives at the region where no magnetic force from the magnet 21 reaches, the carrier 52 is free from the magnet 21 and slips off of the sleeve 20. At the same time, a mutual repulsion between the positively charged sleeve 20 and the positively charged carrier 52 causes the carrier 52 to slip off of the sleeve 20. The negatively charged toner 51 is maintained on the positively charged sleeve 20 due to an electrostatic force therebetween.

If a magnet 211 having the same polarity (e.g., N-polarity) as the magnet (e.g., N-polarity) 210 is further disposed to the photoreceptor side of the magnet 210, the carrier within the magnetic field of the magnet 210 is prevented from further proceeding toward the photoreceptor 7 due to a repulsion field formed by the magnet 210 and 211. Thus, the charged toner 51 alone is carried toward the photoreceptor 7 by the sleeve 20 with the efficient separation of the carrier 52 therefrom. A brush consisting of the toner 51 alone is formed on the sleeve 20. This toner-alone-brush is significantly advantageous over a toner-plus-carrier brush deriving from a two-component developer in that the toner concentration of the tip of the toner-alone-brush is maintained at a certain level.

As the transferring means 4, any of several developing means known to be useful for the tonr development in this invention may be used, an example of which is a non-contact developing means such as a touch-down developing means, a "jumping" developing means, etc. The "jumping" developing means includes a potential application means 40, which applies a high AC bias potential to the substrate side of the back of the photoreceptor 7, thereby allowing a jump of the negatively charged toners 52 from the sleeve 20 to the positively charged latent image 71 on the surface of the photoreceptor 7 and achieving the adhesion thereto. The level of the bias potential 41 to be applied to the substrate side of the photoreceptor 7 can be controlled, so that a certain amount of the toner 51 jumps from the sleeve 20 to the electrostatic latent image 71 to be thereby bound thereto uniformly and reliably, resulting in a uniform and stable toner layer thereon. Since such a development is a non-contact development, the surface of the photoreceptor 7 is not damaged. The toner layer is formed on the electrostatic latent image 71 with the rotation of the photoreceptor drum.

The remaining toner 51 on the sleeve 20 which has turned once is removed from the surface of the sleeve 20 by means of an electroconductive blade 8 made of a metal such as alumina.

It is preferable that the above-mentioned toner 51 forms a uniformly thin layer on the sleeve 20. If the toner layer on the sleeve 20 is extremely thick, the toner unvevenly transfers from the sleeve 20 to the electrostatic latent image on the surface of the photoreceptor 7 in the above-mentioned manner, resulting in a visible image which is inferior in tone reproduction and/or fine-line reproduction. In order to eliminate these problems, a toner vibration means 9, which, for example, vibrates the toner particles 51 on the sleeve 20 to keep them free from each other and/or settle a toner layer thereon, is preferably disposed above the sleeve 20 in front of the magnet 211 in the turning direction of the sleeve 20. As the vibration means 9, a potential application means 90 which applies an AC bias potential to the toner particles 51 can be employed. For the control of the thickness of the toner layer maintained on the sleeve 20, the bias potential application means 30 mentioned above is used or a thickness-regulation board 91 such as a blade is disposed near the surface of the sleeve 20. The function of the regulation board 91 can be incorporated into the vibration means 9 as desired.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A developing process for electrophotography using a two-component developer comprising:

feeding a two-component developer to a non-magnetic sleeve, said developer consisting of an insulative and non-magnetic toner charged with an electrical polarity and a magnetic carrier, maintaining said developer on the sleeve by means of a first fixed magnet disposed behind said sleeve, removing said carrier from said developer on the sleeve to leave said non-magnetic toner on the sleeve by means of at least a second fixed magnet disposed behind said sleeve adjacent said first magnet and between said first magnet and a photoreceptor with said second magnet being of the same polarity as the adjacent portion of said first magnet, and transferring said non-magnetic toner from the sleeve to and electrostatic latent image on the surface of the said photoreceptor.

2. A developing process for electrophotography according to claim 1, wherein said first magnet is disposed at a distance from the surface of the photoreceptor.

3. A developing process for electrophotography according to claim 1, wherein a bias potential having a different polarity from the polarity of said charged toner is applied to said sleeve.

4. A developing process for electrophotography using a two-component developer comprising:

feeding a two-component developer to a non-magnetioc sleeve, said developer consisting of an insulative and non-magnetic toner charged with an electrical polarity and a magnetic carrier, maintaining said developer on the sleeve by means of a first fixed magnet disposed behind said sleeve, removing said carrier from said developer on the sleeve to leave said non-magnetic toner on the sleeve by means of at least a second fixed magnet disposed behind said sleeve adjacent said first magnet and between said first magnet and a photoreceptor with said second magnet being of the same polarity as the adjacent portion of said first magnet, vibrating said non-magnetic toner on the sleeve, and transferring said non-magnetic toner from the sleeve to an electrostatic latent image on the surface of the said photoreceptor.

5. A developing process for electrophotography according to claim 4, wherein said first magnet is disposed at a distance from the surface of the photoreceptor.

6. A developing process for electrophotography according to claim 4, wherein a bias potential having a different polarity from the polarity of said charged toner is applied to said sleeve.

* * * * *